United States Patent [19]

Allen

[11] Patent Number: 4,697,951

[45] Date of Patent: Oct. 6, 1987

[54] MATERIAL SPREADER SYSTEM

[75] Inventor: J. Dewayne Allen, Paragould, Ark.

[73] Assignee: Allen Engineering Corporation, Paragould, Ark.

[21] Appl. No.: 678,706

[22] Filed: Dec. 6, 1984

Related U.S. Application Data

[63] Continuation of Ser. No. 311,674, Oct. 15, 1981, Pat. No. 4,540,312, which is a continuation-in-part of Ser. No. 170,126, Jul. 18, 1980, Pat. No. 4,349,294, which is a continuation-in-part of Ser. No. 101,545, Dec. 10, 1979, abandoned.

[51] Int. Cl.[4] ..... E01C 19/18

[52] U.S. Cl. ..... 404/110; 404/101; 239/659; 239/669; 222/611; 118/308

[58] Field of Search ..... 404/101, 102, 106, 108, 404/110; 118/108, 207, 305, 308, 323; 222/608-614, 623-625, 556, 196; 239/659, 669, 689

[56] References Cited

U.S. PATENT DOCUMENTS

| | | | |
|---|---|---|---|
| 1,743,114 | 1/1930 | Carr | 404/106 |
| 1,833,989 | 12/1931 | Debnam et al. | 239/659 |
| 2,789,485 | 4/1957 | Lindgren | 404/106 |
| 2,832,273 | 4/1958 | Calabrese | 404/106 |
| 3,347,787 | 8/1967 | Sugimoto et al. | 222/196 X |
| 3,392,641 | 7/1968 | Kessel | 404/102 |
| 4,349,294 | 9/1982 | Allen | 404/110 |

OTHER PUBLICATIONS

1968 Concrete Construction Magazine article relating to a material spreader system.

*Primary Examiner*—Stephen J. Novosad
*Assistant Examiner*—John F. Letchford
*Attorney, Agent, or Firm*—Cahill, Sutton & Thomas

[57] ABSTRACT

A material spreader system is designed to dispense a topping material onto the surface of a plastic substance lying within an area having opposing sides. The material spreader system includes a spreader for storing a supply of topping material and for dispensing a layer of the topping material as the spreader is translated along a path. A bridge provides an elevated path to permit widthwise translation of the spreader across the area. Translatable bridge support structure is coupled to the bridge for supporting the bridge above the area while permitting translation of the bridge along the entire length of the area. Drive means is coupled to the spreader to translate the spreader across the path formed by the bridge to thereby dispense a layer of topping material over the entire area. Sequential translations of the spreader across the bridge followed by sequential translations of the bridge along the length of the area covers the entire surface of the area with a layer of topping material.

42 Claims, 25 Drawing Figures

REEL #1
REEL #2
AIR IN
M
V
F
L
90
110
112
136
138
140
150
152
200
204
206
210
212
214
216
218
222
224
226
232
234
236
238
240
242

FIG. 18
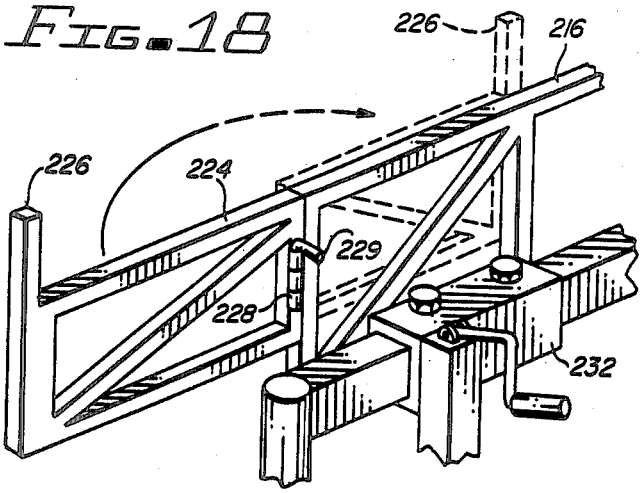
FIG. 19
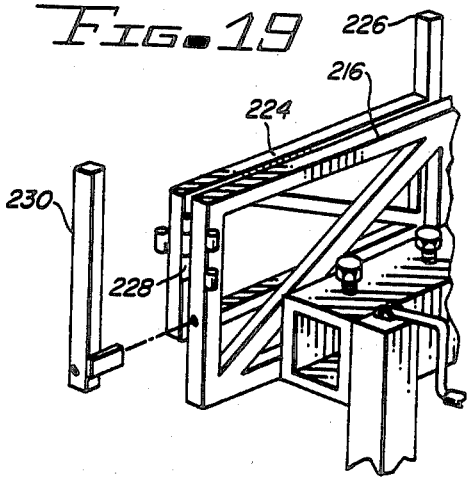
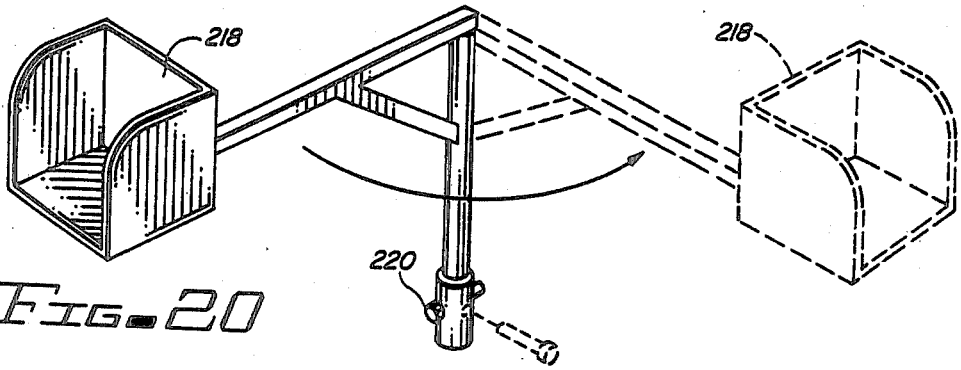
FIG. 20
FIG. 21
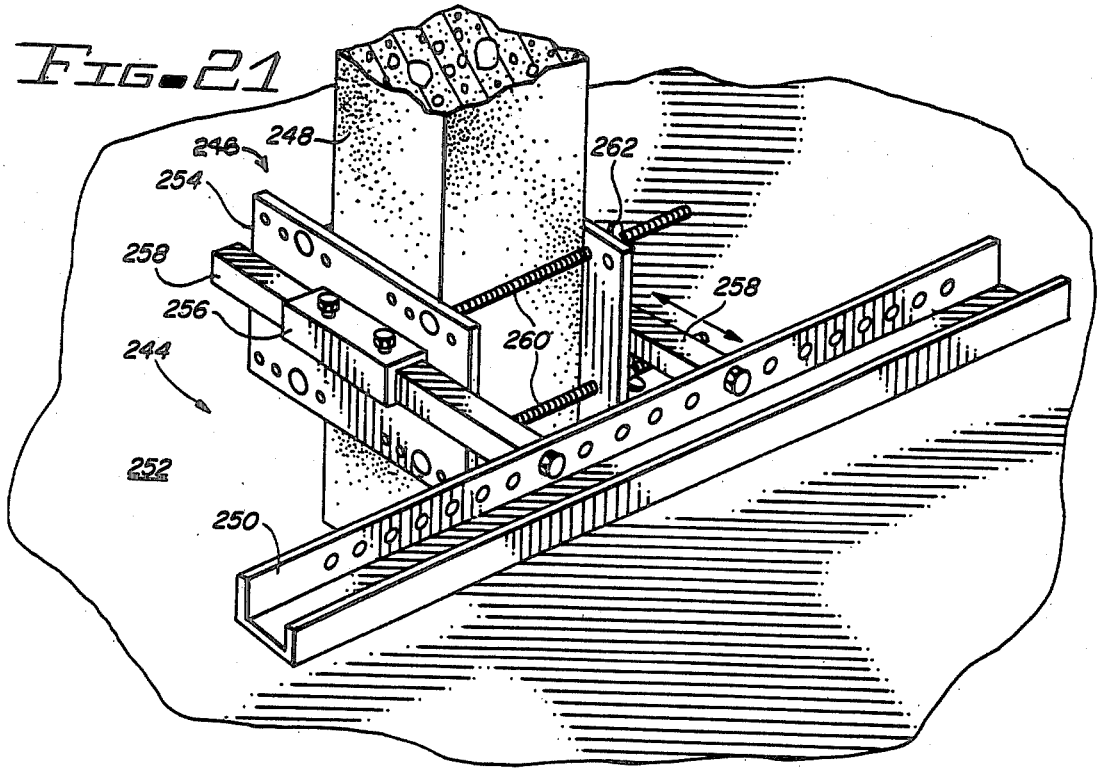

MATERIAL SPREADER SYSTEM

This application is a continuation of U.S. Patent Application Ser. No. 311,674, now U.S. Pat. No. 4,540,312 filed on Oct. 15, 1981 which is a continuation-in-Part of United States Patent Application Ser. No. 170,126, filed on July 18, 1980, now U.S. Pat. No. 4,349,294 which is a continuation-in-part of United States Patent Application Ser. No. 101,545, filed on Dec. 10, 1979, now abandoned.

BACKGROUND OF THE INVENTION

1. Field of the Invention

The present invention relates to material spreading systems, and more particularly, to systems which include a spreader that is translated above the surface of a plastic material which cannot support the spreader.

2. Description of the Prior Art

A variety of different types of floor hardeners have for many years been applied to the plastic surface of uncured concrete. Metallic aggregate is a very finely divided hardener consisting of iron filings. Mineral aggregate hardener (quartz) consists of particulate minerals similar in size to commercially available lawn and garden fertilizer. Traprock and emery rock are floor hardeners having the largest particular size. Miscellaneous other materials are occasionally used as floor hardeners. Each of these floor hardeners is comparatively expensive and may typically cost on the order of twenty cents per pound.

Job application specifications relating to floor hardeners typically state the required coverage density in pounds of floor hardener per square foot of floor surface area. Metallic and quartz aggregate floor hardeners are normally mixed with cement and plasticizers, prebagged, and applied by hand using buckets and wheelbarrows to transport the floor hardener around the job site. Traprock and emery rock floor hardeners are usually hauled in bulk to the job site, transported to the immediate vicinity of the job site by a wheelbarrow and spread over the plastic concrete surface with a shovel.

Application of floor hardener materials by hand or with a shovel requires a great deal of skill and is typically possible only on relatively narrow concrete pour widths. Even skilled construction workers cannot achieve a uniform application rate or a high production rate when working with the floor hardener materials described above.

As a result of the uneven distribution achieved by manual application techniques, a significant excess amount of floor hardener must be applied to the plastic concrete surface to assure that the specified minimum application density is achieved. As a result of the high purchase cost of floor hardener materials, it has been well known for many years that a significant cost reduction in both labor and materials could be achieved if floor hardener materials could be distributed at a high rate and with a uniform application density. A reduction of only one tenth of a pound of floor hardener per square foot of floor area can achieve a significant cost savings and a resulting profit increase, but has been extremely difficult to achieve in practice using prior art techniques.

In the past, a very limited number of contractors have attempted to overcome the shortcomings resulting from manual application of floor hardeners by conducting experiments with domestic lawn spreader equipment. A Scotts lawn spreader having a slotted, manually actuated gate has been used in combination with a dual work bridge or saw horses and a pair of spaced apart planks in an attempt to apply a mineral aggregate floor hardener to a plastic concrete surface. Lawn spreaders were not suitable for use with metallic aggregate since the small size of iron filing particles were incompatible with the lawn spreader mixing and metering systems. The larger size aggregate particles of traprock and emery rock aggregate wedged between the lawn spreader agitator and hopper and jammed in the slotted gate, rendering the device inoperative. Since mineral aggregate floor hardener was similar in consistency to typical lawn fertilizer, only that specific type of floor hardener could be made to function on a rudimentary basis and on very limited pour widths with the Scotts lawn spreader. Because the mineral aggregate particles were dispensed through the spaced apart, slotted apertures in the lower portion of the lawn spreader hopper, the floor hardener material was distributed in spaced apart rivulets, rather than the desired uniform particulate blanket. Numerous difficulties were encountered with steering and manually propelling the two wheel lawn spreader device along the dual work bridge or wooden planks.

These sporadic efforts to distribute even mineral aggregate floor hardeners with a lawn spreader were considered unsatisfactory and were never adopted by the industry.

The prior art includes a variety of different types of material spreaders. U.S. Pat. No. 2,806,435 (Mundell) discloses a suspended refuse spreader which includes a hopper translatable along the length of a pair of fixed, overhead rails. The hopper of this spreader hangs below these fixed support rails and includes a plow-like deflector which deflects the refuse into two spaced apart piles as the spreader is translated along the rails. A cable is attached to one end of the spreader to translate the spreader with respect to the supporting rails.

U.S. Pat. No. 2,807,234 (Middlen) discloses an engine-driven livestock feeding apparatus which can be translated along a pair of fixed rails between which a livestock feed trough is positioned. The material discharged from the lower portion of this apparatus is separated by a deflector within the trough into two heaps so that cattle on both sides of the rail system can be fed.

U.S. Pat. No. 1,200,393 (Neller) discloses an overhead carrier which is translated along a single fixed overhead rail. When the carrier reaches the desired unloading position, the hopper of the carrier is tilted sideways to discharge the contents.

U.S. Pat. No. 3,230,845 (Mauldin) discloses a spreader which rolls over and is supported by the surface upon which material is to be spread. U.S. Pat. No. 3,453,988 (Trent) discloses a portable spreader which is linearly translatable along the length of a pair of fixed rails.

U.S. Pat. No. 2,113,503 (Belkesley) discloses a multiple-purpose spreader which includes a hopper supported by a grouping of three wheels. This topping spreader rolls over the area upon which material is to be discharged.

U.S. Pat. No. 2,318,064 (Delaney) discloses a conventional fertilizer spreader which includes a hopper and a finger agitator rotated by the spreader wheels. A mechanically actuated gate is positioned in the lower portion of the hopper and meters the discharge of material from the spreader.

SUMMARY OF THE INVENTION

Briefly stated, and in accord with one embodiment of the invention, a material spreader system dispenses a topping material onto the surface of a plastic substance lying within an area having a length, width and opposing sides. The area may include a vertically extending obstruction positioned adjacent one of the sides of the area and extending a predetermined distance into the area. The presence of the obstruction within the area defines a reduced width section of the area. The material spreader system includes a spreader for storing a supply of topping material and for dispensing a layer of the topping material as the spreader is translated along a path. Adjustable bridge means having first and second ends provides an elevated path to permit widthwise translation of the spreader across the area. The span of the bridge means includes a length equal to or greater than the width of the area when the bridge means is in an extended position. The bridge means includes means for reducing the span length such that the first end of the bridge means clears the obstruction. Translatable bridge support means is coupled to the bridge means for supporting the bridge means above the area and for permitting translation of the bridge means along the entire length of the area. Drive means is coupled to the spreader for translating the spreader across the path formed by the bridge means to thereby dispense topping material over the area. Sequential translations of the spreader across the bridge means followed by sequential translations of the bridge means along the length of the area covers the entire surface of the area with topping material.

DESCRIPTION OF THE DRAWINGS

The invention is pointed out with particularity in the appended claims. However, other objects and advantages together with the operation of the invention may be better understood by reference to the following detailed description taken in conjunction with the following illustrations wherein:

FIG. 6A illustrates the gate in the closed position while FIG. 6B illustrates the gate in the open position.

FIGS. 18 and 19 illustrate the structure and operation of the pivotable gate sections of the bridge.

FIG. 20 illustrates the manner in which the control station for the spreader is operated to clear a vertically oriented obstruction.

FIG. 21 illustrates the manner in which a clamp assembly is coupled to a vertically oriented obstruction and to a horizontally oriented track.

DETAILED DESCRIPTION OF THE INVENTION

In order to better illustrate the advantages of the invention and its contributions to the art, the various mechanical features of the preferred embodiment of the invention will now be reviewed in detail.

Figure 1:
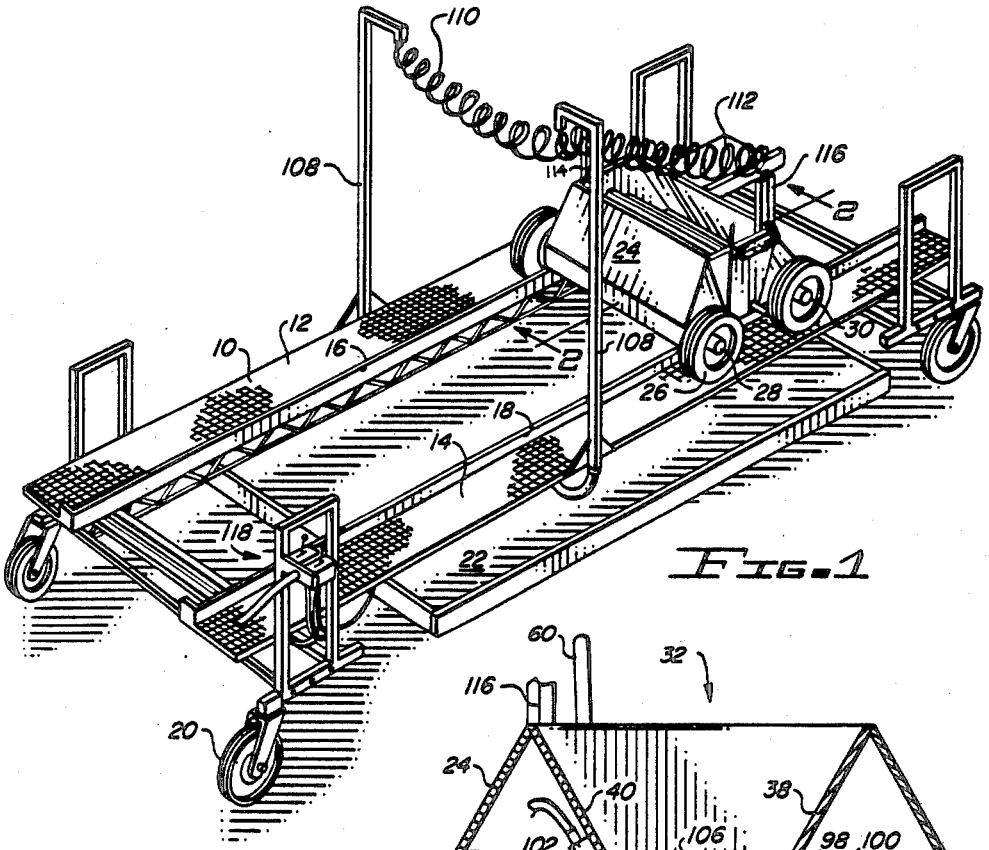
FIG. 1 is a perspective view of the concrete topping spreader system of the present invention.

Referring now to FIG. 1, a multi-section, variable length bridge 10 includes parallel spans 12 and 14. Vertically oriented guide rails 16 and 18 are positioned as shown on the innermost sections of spans 12 and 14. Bridge 10 is supported by a plurality of wheels 20 which are of a fully castering design to facilitate movement and positioning of bridge 10. Bridge 10 is fabricated in sections generally five to ten feet long. A short single section bridge length is illustrated in FIG. 1, but multiple bridge sections can be readily coupled together to form an overall bridge length of sixty-five feet or longer. Bridge 10 is positioned over the upper surface of an area of wet concrete 22. Wheels 20 of bridge 10 are supported either on solid ground, a solid previously cured concrete surface, or any other firm, non-yielding surface.

Referring now generally to FIGS. 1–5, spreader 24 includes four rubber pneumatic tires 26. Tires 26 are rotatably coupled to spreader 24 by axles 28 and 30. Spreader 24 includes a hopper 32 having first and second end surfaces 34 and 36 and first and second side surfaces 38 and 40. End surfaces 38 and 40 are inclined with respect to the vertical axis of spreader 24 and the lower ends of these end surfaces converge to form a widthwise slot 42.

Figure 5:
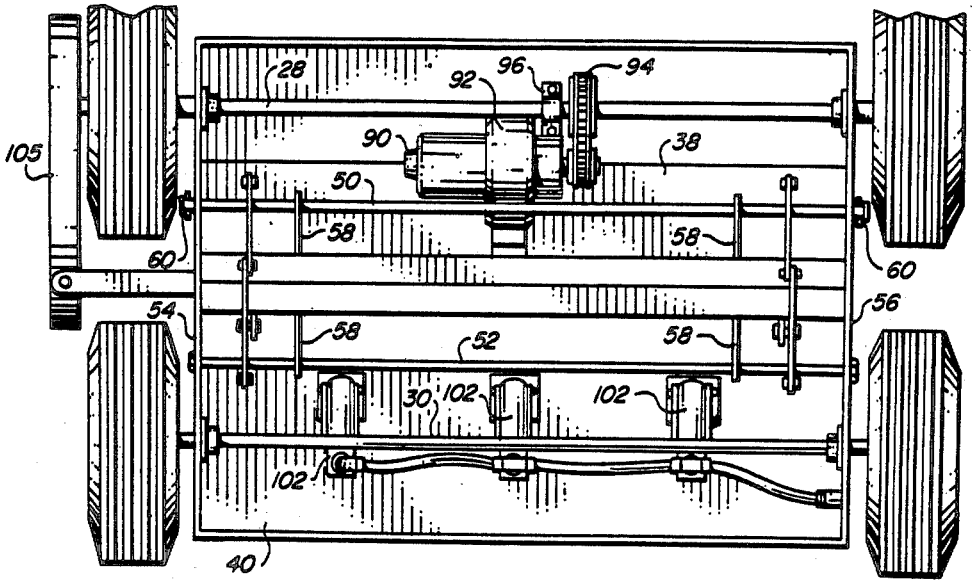
FIG. 5 is a view from below of the spreader illustrated in FIG. 1.
Figure 6A:
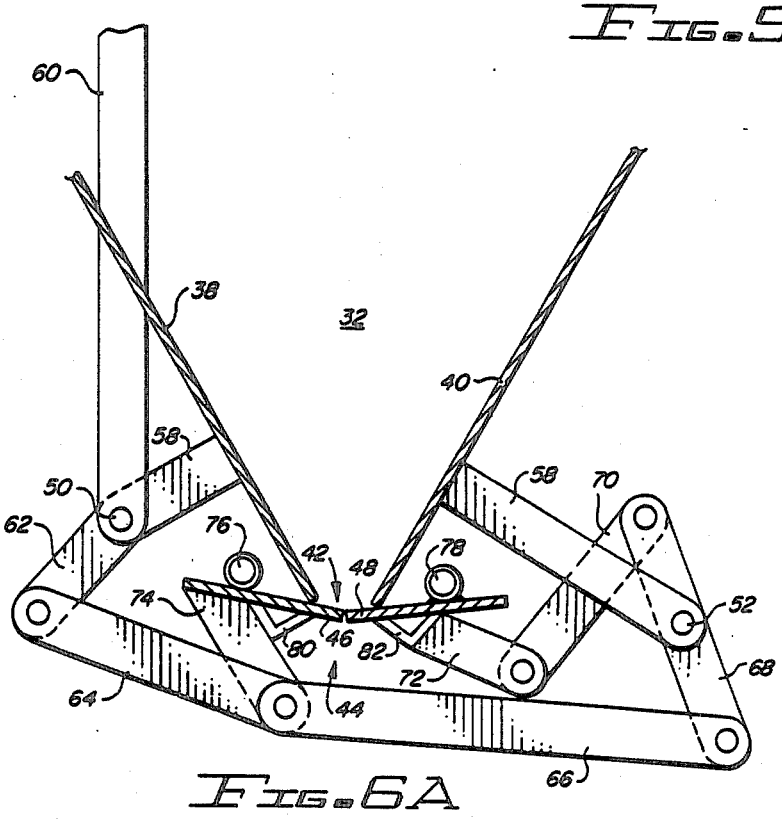
FIGS. 6A and 6B illustrate the spreader gate and linkage which is coupled to the lower portion of the hopper.
Figure 6B:
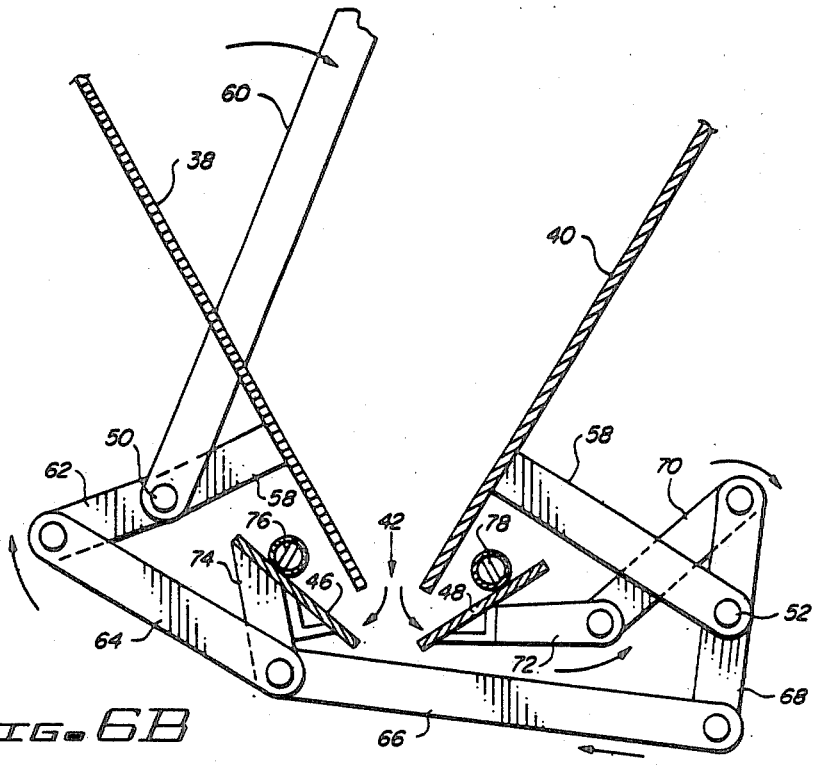

Referring now also to FIGS. 6A and 6B, a gate 44 includes clam shell doors 46 and 48. The linkage which actuates clam shell doors 46 and 48 will be discussed in detail by referring to FIGS. 5, 6A and 6B. Rods 50 and 42 extend through the lower sidewalls 54 and 56 of spreader 24. Rods 50 and 52 are freely rotatable with respect to sidewalls 54 and 56. A group of four standoffs 58 are rigidly mounted to end surfaces 38 and 40 of hopper 32. Rods 50 and 52 are freely rotatable with respect to standoffs 58. On each side of spreader 24, a gate actuator arm 60 is rigidly coupled to rod 50 and extends vertically upward. Rotational displacement of arm 60 causes rod 50 to rotate and thereby rotationally displaces linkage elements 62, 64, 66, 68 70, 72 and 74 as is illustrated in FIGS. 6A and 6B. Clam shell doors 46 and 48 are rotatably coupled to sidewalls 54 and 56 of spreader 24 by rods 76 and 78. Reinforcing elements 80 and 82 are coupled to the lower surfaces of clam shell gates 46 and 48 to provide additional strength and rigidity.

Figure 3:
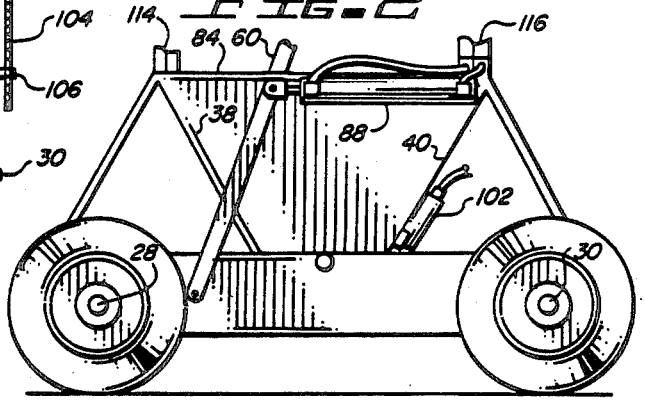
FIG. 3 is a side view, taken from the left-hand side of the spreader illustrated in FIG. 1.

A flange 84 extends horizontally outward from the upper side surfaces of spreader 24 and an actuator arm 60 extends vertically upward through slot 86 in flange 84. Actuator arm 60 is in a vertical position when gate 44 is closed over slot 42. In this closed position, actuator arm 60 contacts and is stopped by the end of slot 86. A clamp can be positioned at a predetermined distance along the length of slot 86 in an arrangement which prevents further movement of actuator arm 60 along the length of slot 86. Clamps can thus be applied to flanges 84 to limit the maximum open position of gate 44. FIG. 3 best illustrates the manner in which pneumatic actuator 88 includes a cylinder which is secured to the side of spreader 24. An actuator arm of actuator 88 is coupled to gate actuator arm 60.

Figure 2:
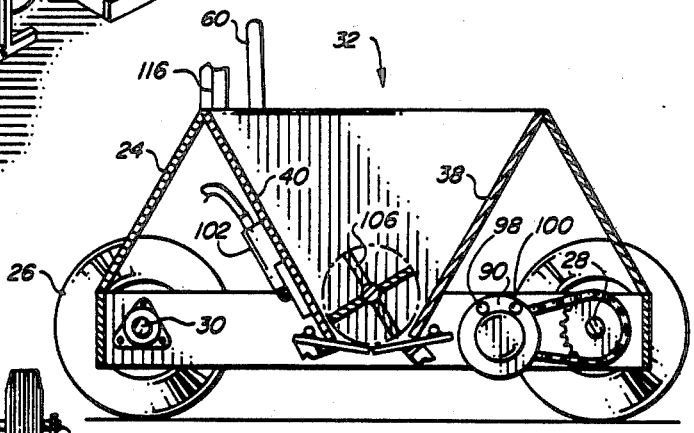
FIG. 2 is a sectional view of the spreader illustrated in FIG. 1, taken along section line 2—2.

Referring now to FIGS. 2 and 5, a 1.3 horsepower sixty PSI high torque pneumatic motor 90 is coupled to surface 38 of hopper 32 by a mounting bracket 92. Motor 90 is commercially available from the Gast Manufacturing Company of Benton Harbor, Mich. (model number 4AM-RV-75-GR20). Sprocket wheels on the output drive shaft of motor 90 and on axle 28 provide a ten to one gear reduction and are coupled together by a drive chain 94. An additional bearing block 96 is coupled to the inner surface of the housing of spreader 24 to more rigidly support axle 28 in the vicinity of motor 90. Motor 90 can be operated in either a forward or a reverse direction depending on whether pressurized air is coupled to port 98 or port 100.

A plurality of three pneumatic air vibrators 102 are coupled to surface 40 of hopper 32 as is best illustrated in FIG. 5. When pressurized air is supplied to the input ports of each of these air vibrators, a weighted piston within the cylinders of each device vibrates up and down along the vertical axis of the device. This piston reciprocates at a rate of ten thousand cycles per minute. Pneumatic air vibrators of this type are commercially available from Allen Engineering Corporation. Note that each of these vibrators is positioned near the lowermost portion of hopper 32 and that these vibrators are separated by a uniform spacing along the width of hopper 32. Air vibrators 102 commence operation when actuator 88 is operated to open gate 44. The vibrations produced by air vibrators 102 cause the topping material within hopper 32 to be uniformly metered from gate 44 and prevent undesired particle build up in hopper 32.

Figure 4:
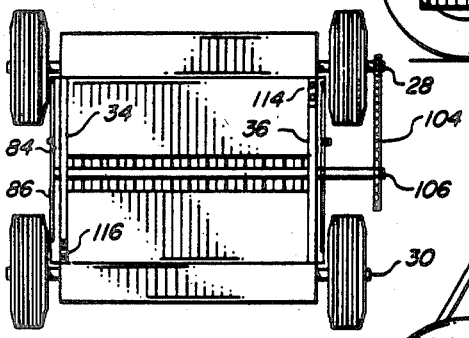
FIG. 4 is a view from above of the spreader illustrated in FIG. 1.

Referring now to FIGS. 4 and 5, a chain 104 surrounds a pair of sprocket wheels which are coupled to the shaft of finger agitator 106 and to axle 28. A chain guard 105 is positioned around chain 104 and serves as a protective device. Since wheels 26 are rigidly coupled to axle 28, the linear translation of spreader 24 along bridge 10 rotates wheels 26 and rotates finger agitator 106 at a rate directly proportional to the rate of translation of spreader 24. Faster movement of spreader 24 causes more rapid rotation of finger agitator 106 and a more rapid rate of discharge of topping material from gate 44 when it is in the open or partially open position. Thus, a uniform topping discharge density is provided which is not affected by the rate of translation of spreader 24.

Referring now to FIGS. 1-3, a pair of support arms 108 extend vertically upward from the midsection of bridge 10. A pair of coiled, flexible double passageway air hoses 110 and 112 extend from support arms 108 to support arms 114 and 116 on spreader 24. Double passageway air hoses 110 and 112 are routed through support arms 108 to a control station 118 on bridge 10. A source of pressurized air (about 60 PSI, 25 C.F.M.) is coupled to control station 118.

The pressurized air coupled to support arm 116 operates actuator 88 and pneumatic vibrators 102. The pressurized air supplied to spreader 24 through support arm 114 is coupled to input ports 98 and 100 of motor 90. One of the two valves in control station 118 controls the air pressure directed to actuator 88 and air vibrators 102 while the second control valve regulates the amount and direction of air coupled to motor 90. This second control valve permits motor 90 to be operated in either forward or reverse directions to regulate the direction of travel of spreader 24. Varying the amount of air pressure transmitted to motor 90 can vary the velocity of spreader 24 from a low translation speed of about twenty feet per minute to a high translation speed of about one hundred feet per minute.

The manner of operating and using the concrete topping spreader of the present invention will now be described in some detail. Generally, a three man crew is required to operate the topping spreader in the most efficient manner. One crew member is primarily responsible for reloading the hopper with the desired topping material. One man operates the control station to regulate the direction and speed of operation of the spreader across bridge 10. The third man assists in laterally translating bridge 10 along a length of a section of concrete over which the topping material is to be distributed. Many different topping materials such as quartz, mineral, metallic, traprock, and emery can be accurately dispensed by the present system.

The desired rate of distribution of topping material is first determined and a clamp or other similar device is positioned along slot 86 of flanges 84. This determines the maximum open position of clam shell gate 44. With typically used topping material, the rate of distribution can be varied from about one tenth of a pound of topping material per square foot to about four pounds per square foot. After the hopper of spreader 24 has been loaded, the operator opens both control valves at control station 118. Actuator 88 is thereby actuated to the open position and motor 90 commences rotation. Rotation of motor 90 causes axle 28 to rotate which rotates chain 104 and thus finger agitator 106. The extreme outer edges of finger agitator 106 are positioned within about one eighth of an inch of side surfaces 38 and 40 of hopper 32 and serve to wipe away any topping material which may have formed an obstruction or bridge and, in addition, insures a free and uniform flow of topping material through clam shell gate 44 at all times. Air vibrators 102 commence operation when actuator 88 causes gate 44 to open.

After spreader 24 has completely traversed the widthwise span of bridge 10 across concrete surface 22, the spreader is stopped, the bridge is laterally translated a distance equal to the width of topping material previously spread and the spreader is translated over the bridge 10 in the opposite direction. This procedure is repeated with intervening reloading steps until the complete surface of the wet concrete has received a layer of topping.

Figures 7, 8:
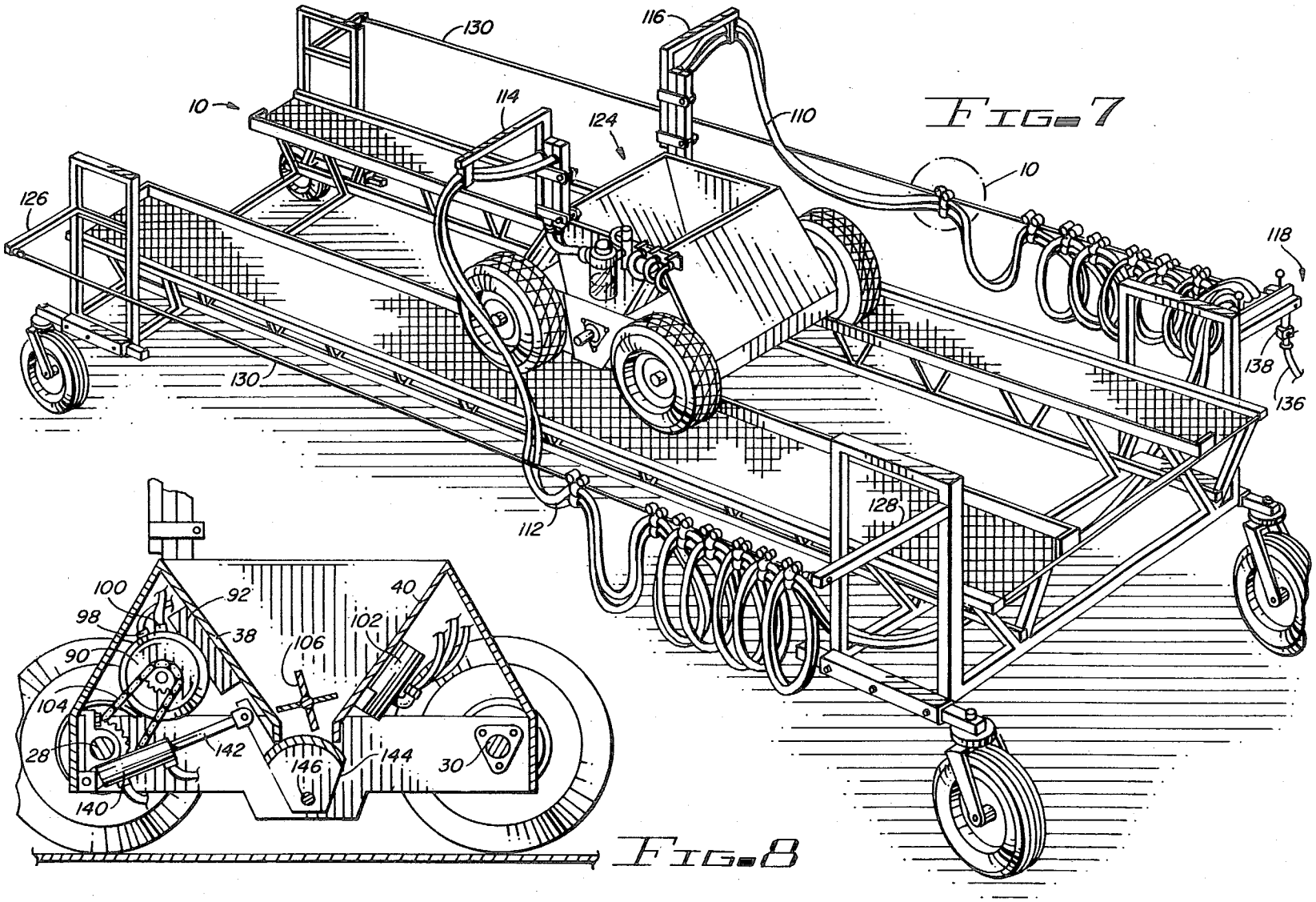
FIG. 7 illustrates a second embodiment of the concrete topping spreader of the present invention which includes a modified lateral support structure for the air supply hose assemblies and a modified spreader gate.
FIG. 8 is a sectional view of the spreader illustrated in FIG. 7.
Figure 9:
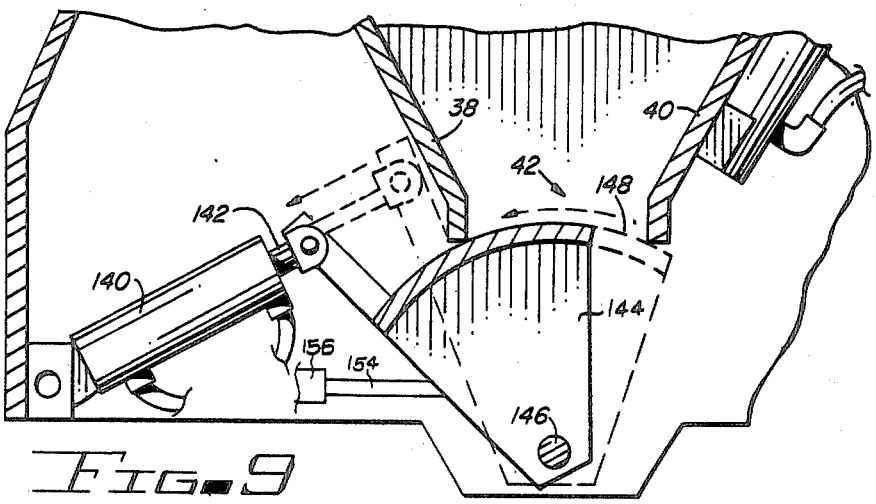
FIG. 9 is a partial sectional view of the spreader illustrated in FIG. 8, illustrating the spreader gate in the "open" and "closed" positions.
Figure 10:
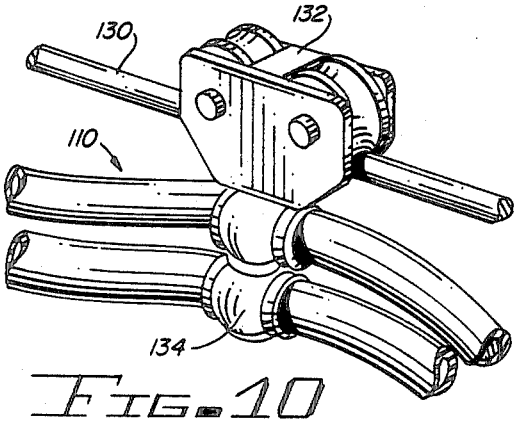
FIG. 10 is an enlarged perspective view of one of the guide-block assemblies illustrated in FIG. 7.

Referring now to FIGS. 7–12, a modified version of the concrete topping spreader will now be described in detail. This modified spreader embodiment illustrated in FIGS. 7–12 will be referred to as spreader 124. FIG. 7 specifically indicates the manner in which dual air hoses 110 and 112 are coupled between bridge 10 and spreader 124. On each side of bridge 10, a pair of outriggers 126 and 128 extend laterally outward and are coupled together by a tightly stretched support cable 130. FIG. 10 specifically indicates that a plurality of laterally translatable guideblocks 132 are coupled at evenly spaced apart intervals to air hose 110. A clamp 134 is coupled to the lower portion of guideblock 32 and includes a pair of cylindrical apertures through which each individual air hose of the dual air hose assembly 110 can be routed. The free end of air hose 110 is coupled to spreader 124 by support 116. The guideblocks are laterally translated back and forth across bridge 10. Air hose 112 is coupled to bridge 10 in a similar manner.

Figure 12:
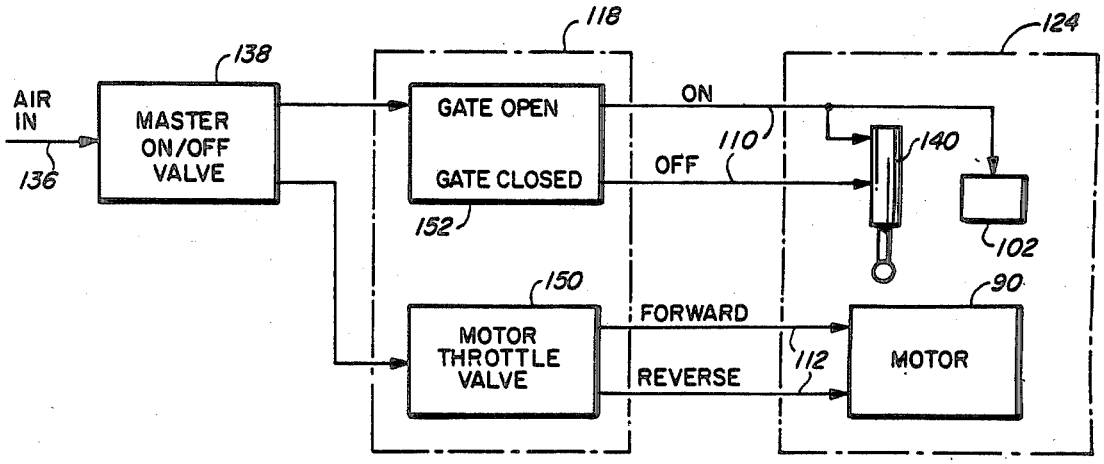
FIG. 12 is a schematic diagram of the pneumatic control and power system for the concrete topping spreader.

Both air hoses 110 and 112 are coupled to a control panel 118. FIGS. 7 and 12 indicate that an air input hose 136 is coupled to master on/off valve 138. Pneumatic valve 150 is coupled to control assembly 118 and air hose 112 and serves as a motor throttle valve. Actuating valve 150 to provide pressurized air to one of the two hoses of hose assembly 112 causes motor 90 to rotate in a forward direction. Controlling the rate of air flow through valve 150 varies the operating speed of motor 90. When pressurized air is coupled by valve 150 to the second air hose of air hose assembly 112, motor 90 rotates in a reverse direction at a rate controlled by the amount of air flow provided.

Control valve 152 in control unit 118 actuates air vibrators 102 and the two pneumatically controlled gate position control cylinders 140. In the first position, valve 152 directs pressurized air through one of the two air hoses in hose assembly 110, causing the shafts of the two air actuator cylinders 140 to be retracted into the position illustrated in FIG. 9. As indicated in FIG. 9, shaft 142 and pneumatic actuator 140 are coupled to gate 144 which pivots about shaft 146 into an open position which establishes a gap indicated by reference number 148 between side surface or first end wall 40 and the smoothly curved cylindrical section which forms the upper surface of gate 144. When control valve 152 is moved into the "off" position, air pressure is removed from the hose which supplies air under pressure to air vibrators 102 and is routed instead to the second air pressure port of actuator cylinders 140. In the "off" position valve 152 directs pressurized air through the second hose of air hose assembly 110 which actuates pneumatic actuator 140 and causes shafts 142 to extend. Extension of shafts 142 rotates gate 144 into the "closed" position and terminates the flow of material through widthwise slot 42 of spreader 124. In FIG. 9, the dotted lines indicate the "closed" position of gate 144.

Figure 11:
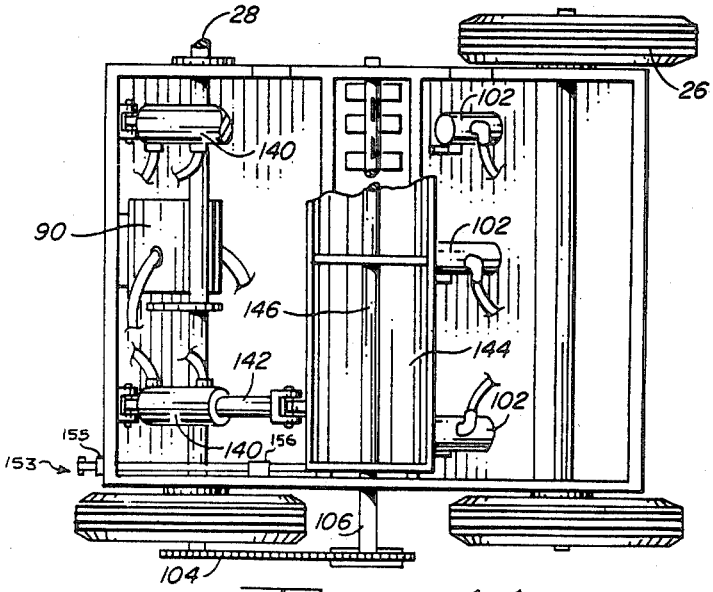
FIG. 11 is a partially cut away view from below of the spreader illustrated in FIG. 8.

Referring now to FIGS. 9 and 11, an adjustable mechanical stop 153 limits the maximum gate displacement into the "open" position to thereby control the rate at which topping is dispensed as spreader 124 is laterally translated. In the preferred embodiment of the present invention, a one inch diameter threaded rod 154 passes through an aperture cut in the lower end wall of the base of spreader 124. A nut 155 is welded to the exterior surface of the base of spreader 124 and causes rotation of rod 154 to displace the end of rod 154 fore and aft with respect to the side of gate 144. A second bolt is welded to the exterior end of rod 154 to permit stop 153 to be readily adjustable by means of a wrench. A hollow tubular support bracket 56 is welded to the interior side surface of the base of spreader 124. Bracket 156 both supports and guides rod 154 and serves to maintain rod 154 in a fixed vertical position with respect to gate 144.

In order to simplify the drawings, only a portion of stop 153 is illustrated in FIG. 9 and only one of the two stops actually used in the preferred embodiment of the present invention is illustrated in FIG. 11. It should be understood that a second stop is provided on the opposite side of the base of spreader 124 so that the one stop abuts each end of gate 144. Generally it will be desireable to either weld a flat plate to gate 144 at the point at which the end of stop 153 will strike the gate or alternatively to form a notch on the end sections of gate 144 so that each end of stop 153 will strike a surface substantially perpendicular to the end of rod 154.

It is generally desirable to fabricate the inclined end walls 38 and 40 of the spreader at an angle approaching 45°. The vibrations produced by air vibrators 102 cause end wall 40 to form a vibrating feeding surface which prevents the topping material contained within the hopper from adhering to this vibrating surface and insures that the topping will flow downward along end surface 40 smoothly and evenly through the gap 148 formed in widthwise slot 42. Finger agitator 106 also assists in providing a uniform flow of topping through gap 148 by maintaining the topping material in a fluffed or agitated state. This fluffing action provided by finger agitator 106 prevents compaction of the topping material which in many circumstanced would cause an uneven and irregular flow of topping material.

The unique structure of the upper surface of gate 144 which is formed in the shape of a section of the wall of a cylinder produces a sliding contact with the lower surfaces of end walls 38 and 40. This unique structure provides a self-cleaning feature of the gate which prevents topping material from adhering to the linear right hand lip surface of gate 144 which defines one side of gap 148. As gate 144 is snapped into the closed position by actuator cylinders 140, the scraping action between the lower edge of end wall 40 and the curved upper lip surface of gate 144 removes all topping from the gate lip.

Stop 153 must be adjusted to the desired setting before the spreading operation is commenced. For many standard types of topping material, the two stops are adjusted so that $\frac{1}{8}''$ gap is established at gap 148 when gate 144 is in the open position. The dimension of gap 148 must always be greater than the diameter of the material to be spread.

Continuously maintaining the self-cleaning lip of gate 144 in a clean condition, the ability to precisely control the dimension of gap 148, the continuous vibration of end wall 40, and the constant translation velocity of spreader 124 enables the present invention to uniformly spread topping material with a distribution accuracy of two to three percent which has previously been unobtainable by any prior art device or technique.

The method of operation of the present invention will now be discussed in detail. First, the hopper is filled with the desired topping material. Motor throttle valve 150 is actuated to propel spreader 124 in the desired direction and at the desired velocity. As the spreader passes above the beginning of the wet concrete surface, control valve 152 is actuated, causing actuator cylinders 140 to snap gate 144 into the desired open position which is determined by stops 153 which have been previously adjusted. In a typical application, stops 153 will be adjusted to provide a ⅛" gap 148. Under normal operation, a single pass of spreader 128 across bridge 10 will distribute topping at the rate of ¼ pound per square foot. If an applica- of one pound per square foot is desired, spreader 124 must make four sequential passes over the same area of wet concrete. The topping is thus distributed in four separate blankets which has been found to produce far superior results than can be attained by a single higher topping distribution rate pass. At the end of the fourth pass, bridge 10 is laterally translated so that spreader 124 can then be translated across the next section of wet concrete four more times. To produce an application rate of 1½ pounds per square foot, six passes of spreader 124 over the wet concrete would be provided.

It will be apparent to those skilled in the art that the concrete spreader system disclosed above may be modified in numerous ways and may assume many embodiments other than the preferred forms specifically set out and described above. For example, a separate wheel could be coupled to the shaft of finger agitator 106 in a manner which would permit it to contact the surface of spans 16 and 18 of bridge 10. In this embodiment, finger agitator 106 rotates at a rate proportional to the spreader translation velocity. Additionally, the spreader may be powered by a gas, electric or hydraulic motor and controlled by a computer or by remote control means receiving radio or optical control signals. Numerous other structural and operational modifications would be readily apparent to one skilled in the art. The concrete topping spreader system of the present invention can be used to spread various types of topping materials over many different types of surfaces and does not require an elevated bridge of the specific type disclosed.

Referring now to FIGS. 13–21, a significantly improved and more sophisticated material spreader system is disclosed. This improved spreader system is designed to dispense a topping material onto the surface of a plastic material such as uncured concrete which is lying within an area having a length, width and opposing sides. At many job sites, the area of plastic material may include a vertically extending obstruction such as a column which penetrates a predetermined distance into the side of the area. Great difficulty has been encountered in efficiently and economically dispensing a topping material over an area which includes a number of vertical obstructions of this type. When using material spreaders of the type disclosed in FIGS. 1–12 above, awkward and difficult techniques such as skewing the bridge deck to spread topping material over plastic concrete lying between a pair of spaced apart columns has proven to be less than satisfactory. Significant amounts of additional time and effort are required to utilize these techniques and to then reposition the spreader/bridge assembly on the opposite side of these vertical obstructions. When vertical obstructions are present on a job site, job completion times and labor expenses are drastically reduced by utilizing the material spreader system illustrated in FIGS. 13–21.

Referring initially to FIGS. 13–16, one embodiment of a material spreader system adapted to dispense a topping material over an area including a vertical obstruction will now be described in detail.

Figures 13, 14, 15:
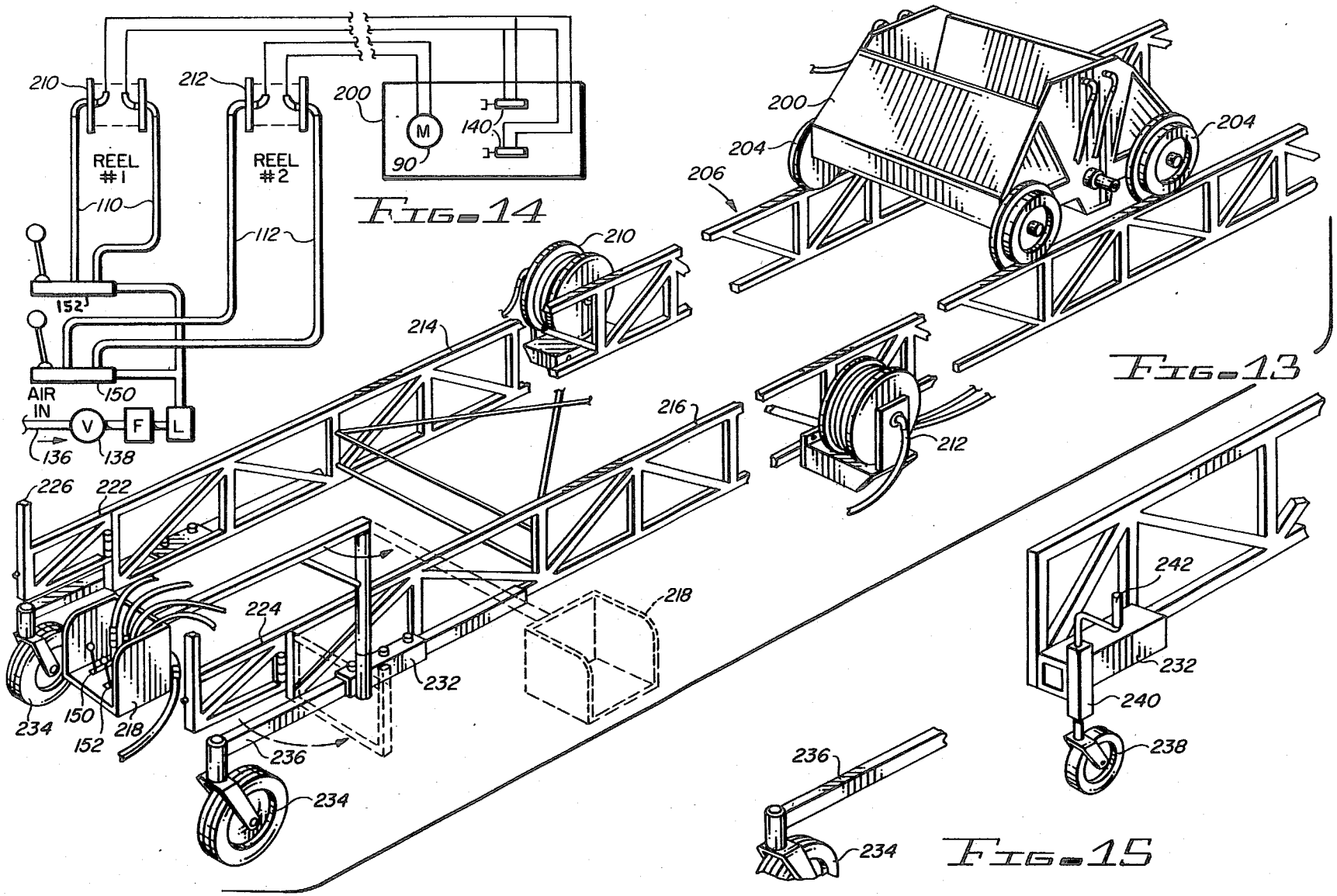
FIG. 13 is a perspective view of an improved material spreader system including adjustable bridge means having means for reducing the span length of the bridge.
FIG. 14 schematically illustrates the configuration of the pneumatic control and power system for the improved material spreader system.
FIG. 15 is a partial perspective view illustrating the manner in which the wheel and wheel mounting bracket of the improved spreader system is coupled to an end of the bridge.
Figure 16:
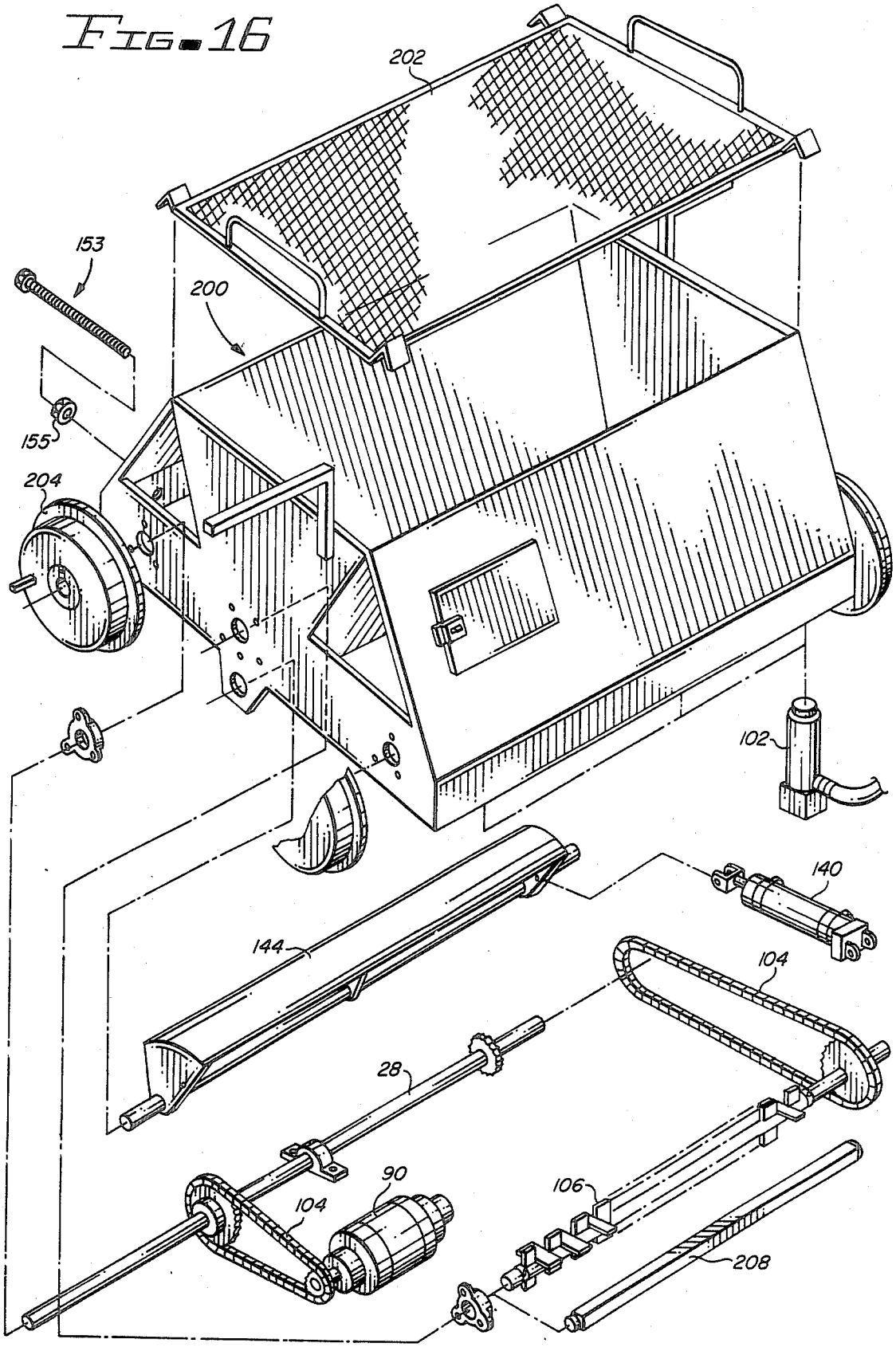
FIG. 16 is an exploded view of the spreader of the improved material spreader system, particularly illustrating the mechanical elements of the spreader.

As is readily apparent from FIG. 16, material spreader 200 is substantially similar in design to material spreader 124 described above and illustrated in FIGS. 7–9 and 11. In FIG. 16, the elements of material spreader 200 have been designated with reference numbers corresponding to reference numbers utilized in connection with the description above of material spreader 124. Material spreader 200 has been provided with a hopper cover 202 which includes an open rectangular grate or screen which assists in separating or breaking up the topping material as the topping material is loaded into the hopper of material spreader 200. In addition, material spreader 200 has been provided with a set of four flanged wheels 204 which couple material spreader 200 to bridge means 206 which is illustrated in FIG. 13. A square tube agitator 208 may be substituted for finger agitator 106 if particularly large size topping material is to be dispensed from the spreader.

FIGS. 13 and 14 illustrate that air hoses 110 and 112 are coupled to take up reels 210 and 212 which are spring biased to minimize slack in the air hoses coupling reels 210 and 212 to spreader 200 as spreader 200 is translated from one end of bridge 206 to the opposite end and back. FIG. 14 illustrates the manner in which spreader 200 is energized and controlled and corresponds to the structure depicted and described in connection with FIG. 12.

Referring now to FIGS. 13, 15, and 18–20, the adjustable bridge means 206 of the present invention will be described in detail. Bridge 206 includes first and second spaced apart spans 214 and 216 which engage the four flanged wheels 204 of spreader 200 and provide an elevated path to permit widthwise translation of spreader 200 across an area of plastic concrete or other surface over which topping material is to be dispensed. FIGS. 13 and 20 illustrate that control valves 150 and 152 are positioned within a control station 218 which is rotatably coupled to the lower end section of span 216. A locking pin 220 maintains control station 218 in a normal or "extended" position depicted in the left side of FIG. 20 or in the "retracted" or obstruction clearance position depicted in dotted lines in the right side of FIG. 20. Control valves 150 and 152 are operative when control station 218 is in either the extended or retracted position.

Referring now to FIGS. 13, 15, 18 and 19, the span length reducing means of bridge 206 will now be described in detail. Each end of spans 214 and 216 of bridge 206 includes pivotable gate sections 222 and 224, each of which includes a vertically extending stop 226 which prevents spreader 200 from being translated beyond either end of bridge 206. Each side of gate sections 224 and 226 includes a three-element hinge 228 and a removable hinge pin 229 which couples the gate sections to the bridge spans. (See FIG. 18) FIG. 19 illustrates that the outer hinge pin has been removed from gate section 224, permitting that gate section to be swung in a clockwise direction into an inboard retracted position shown. Removal of hinge pin 229 from hinge 228 on the opposite side of gate section 224 permits counterclockwise rotation of that gate section over clamp 232 into an outboard retracted position. Gate section 222 includes identical double hinge structure and can also be pivoted into either an inboard or outboard retracted position.

The vertical dimension of gate sections 222 and 224 is less than the vertical dimension of bridge spans 214 and 216 to provide clearance between these gate sections and other structural elements of the spreader system. An auxiliary stop 230 is bolted to the hinged junction between the gate sections and the bridge spans when the gate sections are in the retracted position illustrated in FIG. 19 since stop 226 will have been laterally displaced from the path of wheels 204 and will no longer provide the required stopping feature to prevent inadvertent damage to the equipment.

The material spreader system of the present invention also includes translatable bridge support means which is best illustrated in FIGS. 13, 15, 18 and 19. A clamp 232 is coupled to the lower end section of both ends of bridge spans 214 and 216 and receives each of a pair of wheels 234 and wheel mounting brackets 236. Each end of bridge 206 includes a pair of clamps 232, wheels 234 and wheel brackets 236 which are collectively referred to as a first support means or a first roller assembly. A first roller assembly supports each of the two ends of bridge means 206 and permits the bridge to be translated along the length of the area over which topping material is to be dispensed. Wheels 234 are fully castering pneumatic tire and wheel assemblies of the type described in connection with the spreader depicted in FIG. 7.

The translatable bridge support means of the present invention further includes second means for supporting an end of bridge means 206 as the bridge means is translated along a reduced width section of the area over which topping material is to be dispensed. In the preferred embodiment of the present invention, this second support means includes a second roller assembly which is coupled to each end of spans 214 and 216 of bridge 206. Each element of the second roller assembly includes a small wheel 238, a vertically oriented screw jack assembly 240 which is coupled to tubular clamp 232, and a jack handle. Screw jack assembly 240 is actuated to elevate wheel 238 above the surface of the plastic concrete over which the material spreader system is translated to permit the first roller assembly to support the bridge as the material spreader system is being laterally translated across the full width section of the area of plastic concrete.

Referring now to FIG. 21, roller support means 244 includes a clamp assembly 246 which is coupled around and securely attached to a vertically oriented obstruction in the form of a column 248. Clamp 246 is fabricated from rectangular plates 254, threaded rods 260 and wingnuts 262. A horizontally oriented channel shaped track 250 is coupled to and supported by clamp assembly 246. Clamp assembly 246 includes telescopic adjustment structure which permits the lateral spacing between track 250 and column 248 to be varied as desired so that track 250 can readily engage wheels 238 of the second roller assembly. This telescopic adjustment structure comprises hollow rectangular tubes 256 to which slide tubes 258 are coupled. The set bolts located in the top of tubes 256 lock slide tubes 258 in the desired position with respect to column 248. Alternatively, structure may be provided to telescopically or otherwise adjust either the length of spans 214 and 216 or the relative lateral position of screw jack assembly 240 with respect to spans 214 and 216. The telescopic adjustment feature accommodates either differences in the lateral spacing between pairs of spaced apart columns 248 at a particular job site or accommodates different lateral spacings encountered at various different job sites.

Figure 17A:
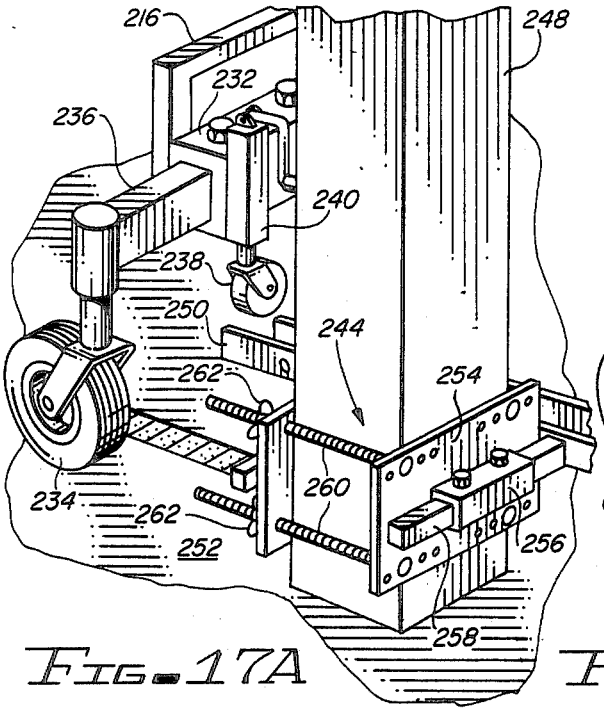
FIGS. 17A–D represent a partially cut away perspective view of the improved material spreader system, particularly depicting the method in which the configuration of the bridge is modified to permit the bridge to be translated past a vertically oriented obstruction.

The manner in which the material spreader system is utilized to spread a uniform layer of topping material over an area including full width and reduced width sections of the type described above will now be described in detail primarily by reference to FIGS. 13 and 17A–D. FIG. 13 and FIG. 17A depict the configuration of the material spreader system which is typically utilized to support the material spreader in an elevated position above an area of plastic concrete. Wheel mounting brackets 236 are coupled to bridge spans 214 and 216 and extend outward a length sufficient to permit wheels 234 to contact an underlying supporting surface 252 adjacent to, but outside of the area of, plastic concrete. Wheels 238 are elevated above the surface of plastic concrete so that the entire bridge assembly is supported by and laterally translated by wheels 234. When a vertical obstruction such as column 248 is approached, clamp assembly 246 together with track 250 is coupled to the column such that the lowest part of the entire clamp/track assembly is elevated at least slightly above the upper surface of the plastic concrete surface.

Figure 17B:
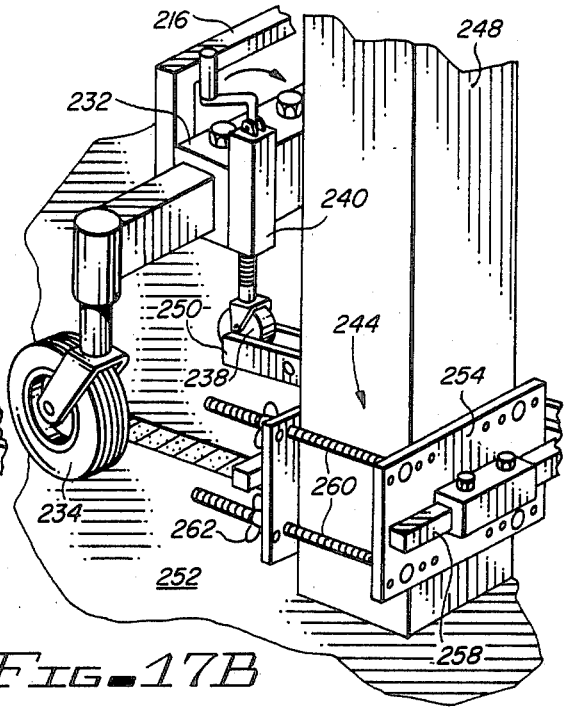

As column 248 is approached, the spreader is moved away from the end of bridge 206, hinge pin 229 is removed and gate section 224 is rotated into the retracted position illustrated in FIG. 19. Auxiliary stop 230 is bolted into place and the entire bridge assembly is translated closer toward column 248. FIG. 17B illustrates that the bridge assembly is then translated toward column 248 so that screw jack assembly 240 can be actuated to cause wheel 238 to engage track 250 and thereby elevate wheel 234 above surface 252 which had previously supported the weight of bridge span 216. Once the weight of span 216 is properly supported by track 250, the securing means of clamp 232 are loosened and the assembly comprising wheel 234 and wheel mounting bracket 236 is completely removed from span 216 as is depicted in FIG. 17C.

Figure 17C:
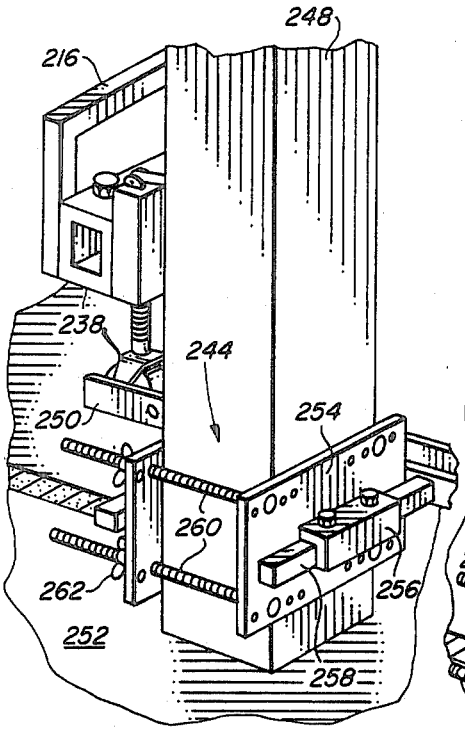
Figure 17D:
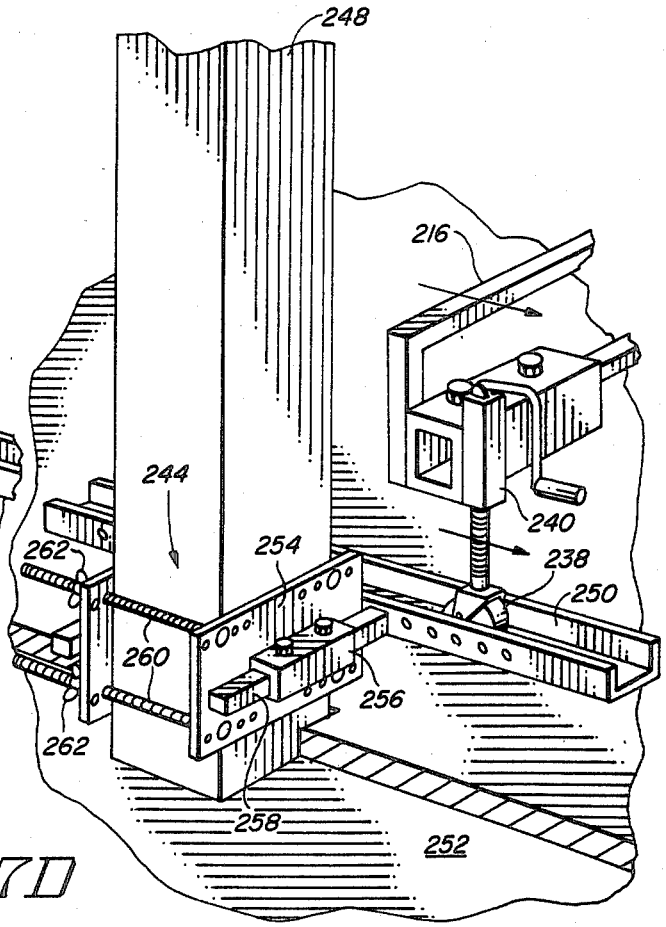

Depending on the relative positioning of columns 248, the operation depicted in FIGS. 17A–17C will take place either sequentially at one end of the bridge followed by the other end of the bridge, or will take place simultaneously when the columns are in paired, spaced apart alignment. In situations where only one side of the area to which topping material is to be applied includes vertically oriented obstructions, the procedures depicted in FIG. 17 will be accomplished for only a single end of bridge 206.

When the configuration depicted in FIG. 17C has been achieved, the bridge will be translated further along the length of the area of the plastic concrete until the spreader is properly aligned to dispense an additional layer of topping material. Bridge 206 can be translated back and forth along the entire length of track 250 as required. When bridge 206 is translated into the position illustrated in FIG. 17D, the assembly consisting of wheel 234 and wheel mounting bracket 236 is reinserted into clamp 232 and properly adjusted and secured. Jack screw assembly 240 is then actuated to transfer the weight from wheel 238 back to wheel 234. As bridge 206 is translated further along the length of plastic concrete, the procedure described immediately above is repeated to support the same end of span 214 above the concrete surface. Typically, with a track of the length and configuration depicted in FIG. 17, only a single span of bridge 206 will be supported by the clamp assembly/track at one time.

Although only a single embodiment of the improved material spreader system has been described, it would be readily apparent to one of ordinary skill in the art to produce a wide variety of structural modifications to this invention which would be equivalent to the invention described above. For example, a clamp assembly could be coupled to column 248 at a point above the spans of bridge 206 and could be engaged by a second support assembly extending upward from the bridge. In another embodiment, translatable bridge support means in the form of a ceiling mounted crane could be coupled by a grouping of cables to bridge 206. When a vertical obstruction such as a column is approached as the ceiling mounted crane is translated along the length of the area of plastic concrete, the adjustable bridge means could be actuated to reduce the length of the bridge spans, permitting translation of spreader 200 over the reduced width section of the area of plastic concrete. Another readily apparent modification of the present invention involves substituting rollers for wheels 234 to permit the bridge means to be translated along and supported by the forms surrounding the area of plastic concrete.

The bridge disclosed in connection with the preferred embodiment of the present invention could also take many different forms other than the specific embodiment described above. Rather than having the pivotable gate sections which permit the span length of the bridge to be increased and decreased as desired, removable end sections, telescopic adjustment features for various other elements of the bridge spans or numerous other types of length adjustment devices could be incorporated into a bridge assembly and still fall within the scope of the present invention. Furthermore, a bridge assembly for supporting a translatable spreader may take the form of a single rail and the spreader could be coupled above, below or on both sides of that rail.

While the material spreader system has been described in connection with dispensing topping material onto a plastic concrete surface, this same invention could be used without modification to dispense a topping material onto a built up roof or onto any other surface which requires a topping or coating material but which cannot permit the wheels of a conventional spreader to contact the surface to be coated with topping material.

Accordingly, it is intended by the appended claims to cover all readily apparent modifications of the invention which fall within the broad scope of the material spreader invention.

I claim:

1. Apparatus for uniformly spreading loose particulate topping material over a concrete surface area having a length, width and opposing sides, said apparatus comprising:

a. moveable spreader means including a hopper for storing a supply of loose particulate topping material and for dispensing a uniformly wide layer of the topping material from an elongated slot in said hopper as said spreader means is translated along a path;

b. bridge means supported above and spanning the width of the concrete surface area without contacting the concrete surface and translatable along the length of the concrete surface area for providing an elevated path to translate said spreader means across a widthwise segment of the concrete surface area and for maintaining said spreader means vertically spaced above and separated from the concrete surface, said bridge means including a triangular truss span for supporting the weight of said spreader means and having i. a horizontally oriented upper surface for engaging said spreader means and for supporting the weight of said spreader means, said surface including first and second spaced apart edges;

ii. an apex positioned below and centered about the horizontally oriented upper surface;

iii. a plurality of struts extending between the apex of said span and the first and second edges of said span;

c. means coupled to said spreader means for metering the discharge of topping material from said elongated slot onto the widthwise segment of the concrete surface area at a rate proportional to the translation velocity of said spreader means across said bridge span and independent of the vertical spacing between said slot and the concrete surface;

d. drive means for translating said spreader means back and forth across said bridge span to thereby dispense a uniform layer of topping material over the widthwise segment of the concrete surface area; and e. drive control means for activating said drive means to control the back and forth translations of said spreader means along said bridge span;

whereby sequential translations of said spreader means across said bridge span followed by sequential translations of said bridge means along the length of the concrete surface area in displacements related to the width of the layer of topping material dispensed by said spreader means covers the entire concrete surface area with a uniform layer of topping material.

2. The apparatus of claim 1 wherein said spreader means includes first and second spaced apart front wheels and first and second spaced apart rear wheels and wherein the upper surface of said bridge span includes guide means for engaging said spreader wheels for directing said spreader means along a linear path as said spreader means is translated back and forth across said span.

3. The apparatus of claim 2 wherein said drive means includes means for rotating at least one of said spreader wheels to translate said spreader means back and forth across said bridge span.

4. The apparatus of claim 3 wherein said metering means includes rotating metering means and wherein said drive means includes means for rotating said metering means.

5. The apparatus of claim 4 wherein said drive control means includes means for activating and deactivating said drive means.

6. The apparatus of claim 5 wherein said drive control means includes reversing means having a first position for actuating said drive means to translate said spreader means along said bridge span in a first direction and a second position for actuating said drive means to translate said spreader means along said bridge span in a second direction.

7. The apparatus of claim 6 wherein said reversing means includes a reversing valve.

8. The apparatus for claim 6 wherein said spreader means further includes means for vibrating said hopper.

9. The apparatus of claim 8 wherein said drive control means controls the operation of said hopper vibration means.

10. The apparatus of claim 5 wherein said metering means further includes means positioned within said hopper and above said elongated slot for agitating the topping material within said hopper.

11. The apparatus of claim 10 wherein said metering means further includes flow control means coupled to said hopper and engaging said elongated slot for controlling the rate of flow of topping material through said slot.

12. Self-propelled apparatus for spreading topping material over a plastic, non-load bearing surface having a length, width, and opposing sides, said apparatus comprising:

a. a spreader including a hopper for storing a supply of loose particulate topping material and for dispensing the topping material through a widthwise slot in said hopper;

b. bridge means supported above and spanning the width of the plastic surface and laterally translatable along the length of said surface, said bridge means including a horizontally oriented span for providing an elevated path across the plastic surface, said bridge span further including guide means for defining a linear path along the length of said span;

c. means coupled to said spreader for translating said spreader in either a forward or a reverse direction across said bridge span including i. drive means for translating said spreader along said bridge span;

ii. spreader to bridge interface means for contacting said bridge span at three or more spaced apart locations to maintain the orientation of said hopper fixed with respect to the horizontal plane as said spreader is translated back and forth across said bridge span, said spreader to bridge interface means including first and second roller units spaced apart along the length of said bridge span for engaging said guide means at linearly spaced apart locations to confine the movement of said spreader to the linear path defined by said bridge span as said spreader is translated back and forth along said bridge span;

iii. control means for actuating said drive means to control the back and forth translations of said spreader along said bridge span; and d. control means coupled to said hopper for regulating the discharge of topping material from said widthwise slot at a rate unrelated to the vertical spacing between said slot and the plastic surface, said flow control means including rotating metering means positioned in proximity to said slot and spanning the length of said slot for controlling the rate of discharge of topping material through said slot;

whereby sequential translations of said spreader across said bridge span followed by sequential lateral translations of said bridge means along the plastic surface enables said apparatus to dispense a uniform layer of topping material onto the plastic surface.

13. The apparatus of claim 12 wherein said flow control means further includes means for vibrating the topping material within said hopper.

14. The apparatus of claim 12 wherein said rotating metering means further includes a plurality of outwardly extending vanes and a centrally located shaft oriented parallel to and vertically displaced from said widthwise slot.

15. The apparatus of claim 12 wherein said drive means further include means for reversing the translation direction of said spreader.

16. The apparatus of claim 12 wherein said flow control means further includes means coupled beneath and spanning the entire length of said widthwise slot for sealing said slot to thereby terminate discharge of the topping material from said hopper.

17. The apparatus of claim 16 wherein said sealing means can be actuated into either a first state wherein topping material is discharged through said slot or a second state wherein the flow of topping material through said slot is terminated.

18. The apparatus of claim 12 wherein said slot includes a length and a width and wherein said flow control means further includes means for varying the effective width of said slot to thereby control the effective discharge area of said slot.

19. The apparatus of claim 18 wherein said slot width control means is capable of closing off said slot to thereby terminate the flow of topping material from said hopper.

20. The apparatus of claim 12 wherein said flow control means is energized by said drive means.

21. The apparatus of claim 20 wherein said guide means includes first and second spaced apart guide rails, wherein the first and second roller units of said spreader to bridge interface means each include a first wheel contacting said first guide rail and a second wheel contacting said second guide rail, and wherein said first and second roller units contact said first and second guide rails at spaced apart intervals.

22. The apparatus of claim 21 wherein said first and second roller units each includes an axle and first and second wheels coupled to the opposing ends of aid axle.

23. The apparatus of claim 21 wherein said first and second guide rails each includes a vertically oriented surface for engaging one wheel of each of said roller units.

24. The apparatus of claim 23 wherein each of said first and second roller units includes first and second wheels for engaging the vertically oriented surfaces of said first and second guide rails.

25. The apparatus of claim 24 wherein said first roller unit contacts said bridge span at two laterally spaced apart locations.

26. The apparatus of claim 23 wherein said flow control means further includes means coupled beneath and spanning the entire length of said widthwise slot for sealing said slot to thereby terminate discharge of said topping material from said hopper.

27. The apparatus of claim 26 wherein said flow control means further includes means coupled to said spreader for vibrating the topping material within said hopper.

28. The apparatus of claim 12 wherein said control means further includes means for actuating said drive means and said flow control means.

29. The apparatus of claim 28 wherein said control means simultaneously actuates said drive means and said flow control means.

30. The apparatus of claim 28 wherein said drive means further include means for reversing the translation direction of said spreader.

31. The apparatus of claim 30 wherein said flow control means further includes means for vibrating the topping material within said hopper.

32. The apparatus of claim 31 wherein said rotating metering means further includes a plurality of outwardly extending blades and a centrally located shaft oriented parallel to and vertically displaced from said widthwise slot.

33. The apparatus of claim 31 wherein said vibrating means further includes a plurality of vibrators coupled to said hopper at spaced apart intervals.

34. The apparatus of claim 30 wherein said hopper includes first and second inclined opposing walls having upper and lower surfaces and wherein the lower surface of said walls converge to form said widthwise slot.

35. The apparatus of claim 12 wherein said drive means includes a motor forming a part of said spreader.

36. The apparatus of claim 35 wherein said motor includes a pneumatic motor and wherein said drive means further includes a source of compressed air and means for coupling said compressed air source to said motor.

37. The apparatus of claim 36 wherein said air source is spaced apart from said material spreading apparatus.

38. The apparatus of claim 35 wherein said flow control means further includes means coupled to said spreader for vibrating the topping material within said hopper.

39. The apparatus of claim 35 wherein said drive means further includes means for controlling the spreader translation velocity.

40. Self-propelled apparatus for spreading topping material over a plastic, non-load bearing surface having a length, width, and opposing sides, said apparatus comprising:

a. a spreader including a hopper for storing a supply of loose particulate topping material and for dispensing the topping material through a widthwise slot in said hopper;

b. bridge means supported above and spanning the width of the plastic surface and laterally translatable along the length of said surface, said bridge means including a horizontally oriented span for providing an elevated path across the plastic surface, said bridge span further including guide means for defining a linear path along the length of said span;

c. means coupled to said spreader for translating said spreader in either a forward or a reverse direction across said bridge span including i. drive means including a motor forming a part of said spreader for translating said spreader along said bridge means and means for controlling the spreader translation velocity;

ii. spreader to bridge interface means for contacting said bridge span at three or more spaced apart locations to maintain the orientation of said hopper fixed with respect to the horizontal plane as said spreader is translated back and forth across said bridge span, said spreader to bridge interface means including first and second roller units spaced apart along the length of said bridge span for engaging said guide means at linearly spaced apart locations to confine the movement of said spreader to the linear path defined by said bridge span as said spreader is translated back and forth along said bridge span;

iii. control means for actuating said drive means to control the back and forth translations of said spreader along said bridge span; and d. flow control means coupled to said hopper for regulating the discharge of topping material from said widthwise slot at a rate unrelated to the vertical spacing between said slot and the plastic surface, said flow control means including rotating metering means positioned in proximity to said slot and spanning the length of said slot for controlling the rate of discharge of topping material through said slot;

whereby sequential translations of said spreader across said bridge span followed by sequential lateral translations of said bridge means along the concrete surface enables said apparatus to dispense a uniform layer of topping material onto the concrete surface.

41. The apparatus of claim 40 wherein said control means includes means for reversing the translations direction of said spreader.

42. The apparatus of claim 41 wherein said control means includes means for reversing the translation direction of said spreader and wherein said drive means energizes said flow control means.

* * * * *